United States Patent [19]

Mucciarone

[11] Patent Number: 4,471,885

[45] Date of Patent: Sep. 18, 1984

[54] BOX FOR SELECTIVELY DISPLAYING AND STORING INFORMATION CONTAINED ON A STACK OF REUSABLE CARDS

[76] Inventor: Domenick Mucciarone, 3645 Boca Ciega, Naples, Fla. 33942

[21] Appl. No.: 403,729

[22] Filed: Jul. 30, 1982

[51] Int. Cl.[3] ..... A47F 1/06

[52] U.S. Cl. ..... 221/155; 221/232; 221/281

[58] Field of Search ..... 221/2, 60–61, 221/36–37, 41, 57, 59, 66, 155, 228–229, 232, 247, 268, 270, 281, 102; 312/61, 71

[56] References Cited

U.S. PATENT DOCUMENTS

| | | | |
|---|---|---|---|
| 1,680,275 | 8/1928 | Albaugh | 221/155 X |
| 1,689,571 | 10/1928 | West | 221/62 X |
| 2,456,068 | 12/1948 | Liben | 221/61 X |
| 2,641,358 | 6/1953 | Santo | 221/232 |
| 3,941,244 | 3/1976 | Brawnetz | 221/66 X |
| 4,045,102 | 8/1977 | Austin | 312/71 X |

FOREIGN PATENT DOCUMENTS

| | | | |
|---|---|---|---|
| 614472 | 2/1961 | Canada | 221/232 |
| 749882 | 5/1933 | France | 221/66 |

*Primary Examiner*—Charles A. Marmor
*Attorney, Agent, or Firm*—Merrill N. Johnson

[57] ABSTRACT

A container for storing and displaying a reusable stack of cards bearing recorded information, comprising a four sided box, a cover hinged to one side of said box with a flange which, when the box is closed, fits over all four sides of the box, a transparent sheet mounted horizontally inside said box across the upper face of the box, a card-supporting shelf movable up and down within said box, a helical coiled spring positioned beneath said shelf to move said shelf and its stack of cards upwardly against said transparent sheet, a first horizontal slot in the hinged back side of the box for insertion of a card into the box and at the bottom of the stack of cards, a second horizontal slot in the opposite front side of said box positioned beneath the transparent sheet to permit the top card of the stack to be removed from the box, and mechanism mounted on the transparent sheet for engaging the top card of the stack and moving the card out of the box through the second slot.

3 Claims, 5 Drawing Figures

BOX FOR SELECTIVELY DISPLAYING AND STORING INFORMATION CONTAINED ON A STACK OF REUSABLE CARDS

BACKGROUND OF THE INVENTION

I have invented a unique device, which I call a Memory Box, which provides a permanent record as well as a monthly reminder of important dates such as birthdays and anniversaries of the family, relatives and close friends.

Preferably my Memory Box is constructed from a tastefully decorated metal box which presents a pleasing view to the eye and thus will be a welcome addition to any desk or dressing table.

The flanged cover of the Memory Box contains on its inside face a card onto which important dates and other information can be recorded.

The box itself houses a stack of twelve reusable cards—one for each month—onto which the owner of the box will have made a permanent record of the names and dates of persons and events to be remembered. The current month's card is put on the top of the stack, the next month's card beneath it, followed by the remaining cards in monthly succession. The cards are made of a stiff paper stock, preferably 1/64th to 1/16th of an inch in thickness.

A transparent plastic or glass sheet is mounted longitudinally across the upper open face of the box. The stack of cards is pushed upwardly against the sheet by a card-supporting shelf. The shelf has essentially the same outer dimensions as the cards and is movable up and down within the box by a helical coiled spring positioned beneath the shelf. The upper end of the spring rests against the lower surface of the shelf while the spring's lower end rests against the bottom of the box or a base resting on the box's bottom surface.

The shelf includes an upwardly inclined slide which projects upwardly from the back side of the shelf at an angle of about 30° with the upper face of the shelf. The slide includes an upper edge which is horizontally coextensive with the surface of the shelf and lies in the same horizontal plane as the opposite edge of the shelf. The stack of cards rests upon the upper edge of the slide and the front side of the shelf.

The box has two horizontal slots in its sides. One slot is located across the hinged or back side of the box and the other slot across the front side opposite to the hinged side of the box, each slot being long enough and wide enough to permit a card to pass through the slot.

The slot in the hinged or back side is located so that a card inserted into the box through the slot will first contact the inclined slide of the shelf. The leading edge of the card will be guided along the upper surface of the slide and as the card is pushed further into the box, the card's leading edge will contact the lower surface of the bottom card in the stack. When the trailing edge of the card is finally pushed through the slot, the inserted card becomes the bottom card in the stack resting upon the shelf and urged upwardly by the spring.

The slot in the opposite or front side of the box is located immediately beneath the lower face of the transparent sheet and a finger-operated card-engaging mechanism is slidably mounted on the sheet to remove the top card from the box. Preferably this mechanism consists of a shuttle having a finger-engaging tab projecting above the upper surface of the sheet and a downwardly projecting single card-engaging horizontal flange sized to move only the top card of the stack out through the horizontal slot in the front side of the box.

The shuttle is mounted to be movable within a horizontal slot in the transparent sheet so that when a human finger is pressed downwardly against the tab and then moved forwardly in the slot, the flange resting against the back edge of the uppermost card urges that card forward into the slot in the front of the box. The leading edge of the card projecting out of the box can then be grasped in one's fingers and slid out of the box. That card is then reinserted into the slot in the back of the box to reappear as the visible top card of the stack eleven months hence.

DETAILED DESCRIPTION OF THE INVENTION

My Memory Box provides a permanent record and also a covenient monthly reminder of important annually recurring dates such as birthdays and anniversaries of the immediate family, relatives and friends. The information to be remembered is transcribed onto a stack of twelve similiar cards, one card for each month of the year. The cards are stacked in chronological order with January on top and December on the bottom.

Figure 1:
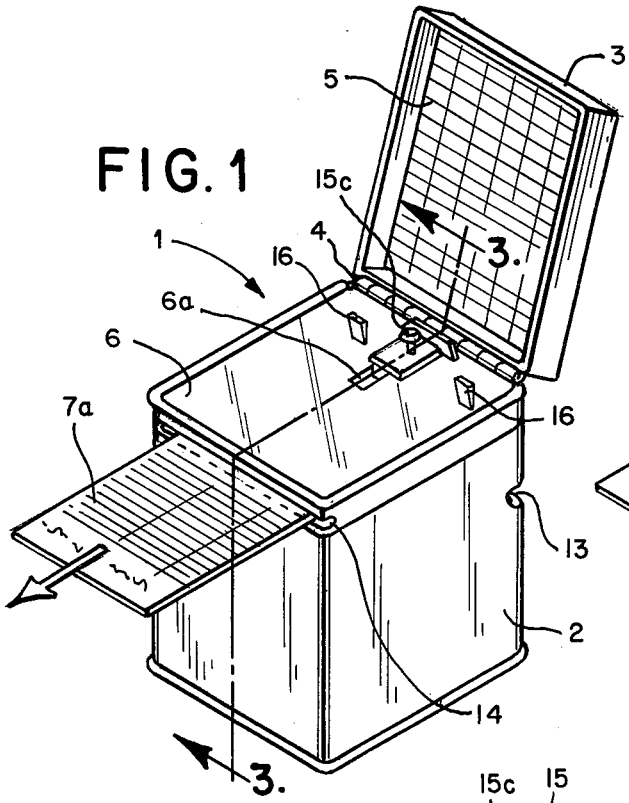
FIG. 1 is a perspective view of a preferred embodiment showing the front and side of the box and also showing the Memory Box with its cover open and a card being withdrawn from the box.
Figure 3:
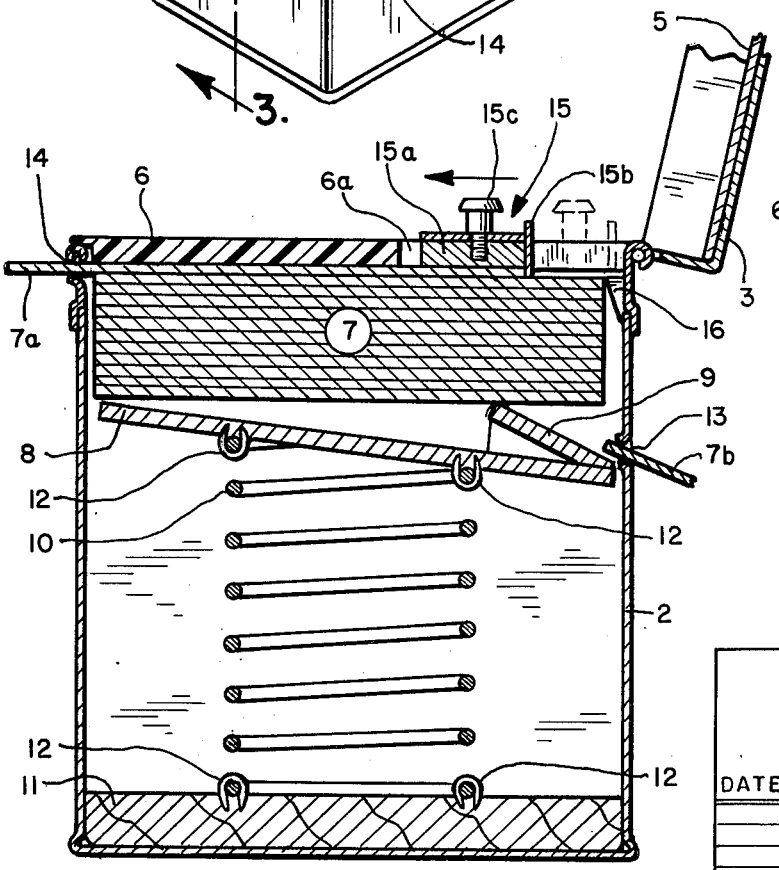
FIG. 3 is a cross-sectional view taken along line 3—3 of FIG. 1 showing the shuttle moving the top card out of the box.

The twelve cards are housed within a Memory Box shown as box 1 in FIG. 1 of the drawings. Box 1 is preferably made of thinly rolled steel stock and has a cube-like base 2 with an open upper face and a flanged cover 3 attached to the base 2 by a hinge 4 extending along the back side of the box. As shown in FIGS. 1 and 3, a rectangular card 5 may be inserted into the inside face of flanged cover 3. Card 5 will have important data transcribed onto it by the owner of the box, which information becomes visible upon opening of the box.

The entire outside of box 1 including its cover 3 is tastefully decorated so that the box presents a pleasing view to the eye. Thus the box will make an attractive accessory on any desk, dressing table or shelf.

Figure 4:
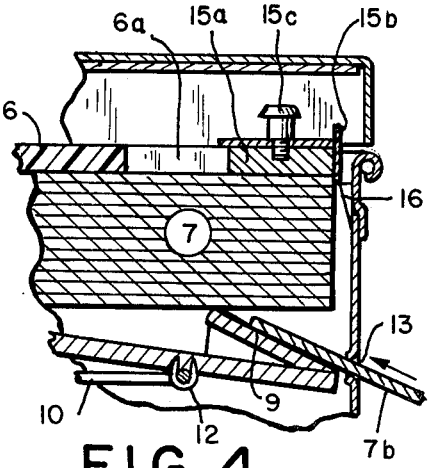
FIG. 4 is a partially broken away cross-sectional view taken along line 4—4 of FIG. 2 showing a card being inserted into the slot in the back of the box.
Figure 5:
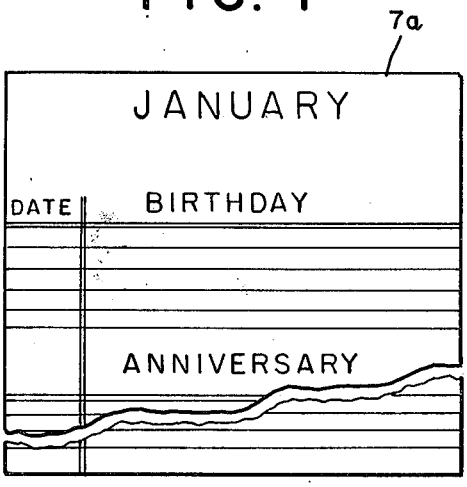
FIG. 5 is a partially broken away frontal view of one of the cards which makes up the stack of cards within the Memory Box.

A transparent sheet 6 of glass or plastic is mounted horizontally across the open upper face of base 2. As best shown in FIGS. 3 and 4, a stack 7 of twelve cards is inserted into box 1 with the top card **7*a* for January (shown in detail in FIG. 5) on the top of stack 7 and the card bearing information for December on the bottom of stack 7**.

The cards comprising stack 7 are made of high quality stiff paper stock preferably having a thickness of from 1/64th to 1/16th of an inch. As illustrated in FIG.

5 each card bears a printed heading of one of the months of the year, followed by a series of lines for recording dates and names of important events to be remembered during that particular month.

The stack of cards are supported and positioned within the box by a shelf 8 which is rectangular and dimensioned to fit generally horizontally within the box. Shelf 8 includes a slide 9 which projects upwardly at an angle of about 30° from the back side of the shelf and ends in an upper edge which is coextensive with shelf 8.

Shelf 8 and its slide 9 are positoned within base 2 of the box by a coiled helical spring 10 which is mounted on a flat horizontal plate 11. Plate 11 is dimensioned to rest snugly but removably upon the bottom of base 2 of the box. Spring 10 is attached to the lower face of slide 8 and to the upper face of plate 11 by a series of staples 12 best shown in FIG. 3.

Shelf 8 is attached to spring 10 so that the front edge of the shelf and the upper edge of slide 9 lie in the same horizontal plane. Thus the stack of cards 7 resting on the front edge of shelf 8 and the upper edge of slide 9 will be urged upwardly by the action of coiled spring 10 so that the uppermost card of the stack is pressed against the lower face of transparent sheet 6, as best shown in FIG. 3.

In order to remove the top card from the box at the end of the month so that the next month's card becomes visible beneath the transparent sheet and to permit the removed card to be inserted into the box at the bottom of the stack, two slots are provided in opposite sides of the box, namely, slot 13 in the back side and slot 14 in the front side of the box.

Slot 13 is horizontally positioned just above the back side of shelf 8 and slot 14 is horizontally positioned just beneath the lower face of transparent sheet 6 in the front side of the box. Each slot is dimensioned to permit the unobstructed passage of a single card through the slot.

At the end of a month mechanism is provided for removing the top card from the box. Preferably this mechanism is in the form of a shuttle 15 which includes a shuttle base 15*a*, a downwardly projecting flange 15*b*, and a finger-operated tab 15*c*, which are best shown in FIG. 3.

Shuttle 15 is mounted on a slot 6*a* in sheet 6 as shown in FIGS. 1, 3 and 4. In order to position the stack of cards toward the front of box 1 to insure the movement of top card 7*a* by the shuttle, a pair of wedges 16 are affixed to the inside surface of the back side of base 2 as best shown in FIG. 1.

When it is desired to remove top card 7*a* from the box, a human finger presses down on tab 15*c* and shuttle 15 is slid along slot 6*a* to the back of the box to the position shown in FIG. 4. In this position flange 15*b* will rest against the back edge of card 7*a*. Then the finger moves shuttle 15 forwardly along slot 6*a*, causing card 7*a* to move out of slot 14 as shown in FIG. 3. Now card 7*a* can be grasp in the hand and removed from the box as shown in FIG. 1.

Figure 2:
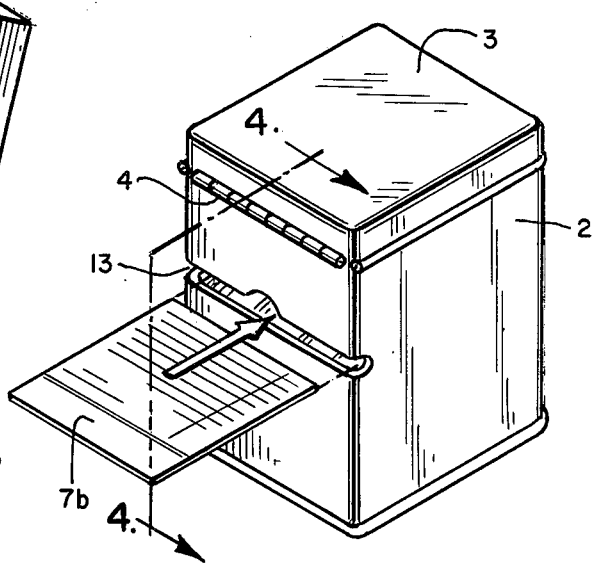
FIG. 2 is also a perspective view of the Memory Box with its cover closed taken from the hinged or back side of the box and showing a card being inserted into the box.

To return a card into the box, the card (shown as card 7*b* in the drawings) is inserted into slot 13 in the back of the box. FIG. 2 shows the card 7*b* about to be inserted into slot 13; FIG. 3 shows the card being inserted into slot 13; and FIG. 4 shows card 7*b* sliding upwardly along slide 9 as it is being pushed through slot 13.

I have shown the preferred form of my Memory Box. However, variations and modifications of its various parts and particularly the mechanism for removing a card from the box will be apparent to those skilled in the art. Accordingly, my invention is limited only by the spirit and scope of the appended claims.

I claim:

1. A container for storing and displaying information contained on the upper face of the top card of a stack of reusable cards bearing recorded information, said container comprising a four sided box, a cover hinged to one side of said box and including a flange which when the cover is closed, fits over all four sides of the box, a rigid transparent sheet mounted horizontally across the upper face of the box, a card-supporting shelf movable up and down within said box, a helical coiled spring positioned beneath said shelf to move said shelf and its stack of cards upwardly against said transparent sheet, a first horizontal slot in the hinged side of the box for insertion of a card into the box and at the bottom of the stack of cards, a second horizontal slot in the opposite side of said box positioned beneath said transparent sheet so as to permit the top card of the stack to be removed from the box, and mechanism slidably mounted on the transparent sheet for engaging only the top card of the stack and moving the top card out of the box through said second slot.

2. A container as claimed in claim 1 in which the card-supporting shelf includes an upwardly extending slide projecting at an angle of about 30° from the back side of said shelf.

3. A container as claimed in claim 1 or 2 in which the mechanism for moving the top card out of the box is a shuttle having an upper tab engagable by a human finger and a downwardly projecting flange dimensioned so that as the tab is pressed downwardly, the flange will engage only the edge of the uppermost card in the stack of cards.

* * * * *